US009347246B2

(12) United States Patent
Orzech et al.

(10) Patent No.: US 9,347,246 B2
(45) Date of Patent: May 24, 2016

(54) OPENING AND/OR CLOSING MECHANISM ON DOORS, GATES/FLAPS OR THE LIKE, IN PARTICULAR ON MOTOR VEHICLES

(75) Inventors: Udo Orzech, Velbert (DE); Hans-Günter Kaiser, Wuppertal (DE)

(73) Assignee: HUF HULSBECK & FURST GMBH & CO. KG, Velbert (DE)

( * ) Notice: Subject to any disclaimer, the term of this patent is extended or adjusted under 35 U.S.C. 154(b) by 1265 days.

(21) Appl. No.: 12/849,434

(22) Filed: Aug. 3, 2010

(65) Prior Publication Data

US 2011/0031767 A1 Feb. 10, 2011

(30) Foreign Application Priority Data

Aug. 7, 2009 (DE) ..... 20 2009 010 681
Oct. 24, 2009 (DE) ..... 10 2009 050 905

(51) Int. Cl.
*E05C 3/06* (2006.01)
*E05B 77/04* (2014.01)
*E05B 77/02* (2014.01)
*E05C 3/16* (2006.01)

(52) U.S. Cl.
CPC ..... *E05B 77/04* (2013.01); *E05B 77/02* (2013.01); *Y10T 292/444* (2015.04)

(58) Field of Classification Search
CPC ..... E05B 77/02; E05B 77/04
USPC ..... 292/216, DIG. 23, DIG. 53, DIG. 73
See application file for complete search history.

(56) References Cited

U.S. PATENT DOCUMENTS

| | | | | |
|---|---|---|---|---|
| 5,860,683 | A * | 1/1999 | Sekino et al. | 292/216 |
| 6,010,164 | A | 1/2000 | Yoda | |
| 6,012,747 | A * | 1/2000 | Takamura et al. | 292/216 |
| 6,789,825 | B2 * | 9/2004 | Kalargeros et al. | 292/216 |
| 7,048,313 | B2 * | 5/2006 | Fukunaga et al. | 292/216 |
| 7,188,872 | B2 * | 3/2007 | Kalargeros et al. | 292/216 |
| 7,195,292 | B2 * | 3/2007 | Ketelsen et al. | 292/216 |
| 7,631,907 | B2 * | 12/2009 | Sato | 292/216 |
| 7,789,440 | B2 * | 9/2010 | Graute et al. | 292/216 |
| 2007/0278802 | A1 * | 12/2007 | Hanisch | 292/340 |

FOREIGN PATENT DOCUMENTS

| | | | |
|---|---|---|---|
| DE | 1 948 907 | A1 | 4/1971 |
| DE | 101 14 966 | A1 | 10/2002 |
| DE | 101 30 260 | A1 | 10/2002 |
| DE | 20 2005 005 689 | U1 | 9/2006 |
| DE | 10 2008 005 575 | A1 | 8/2009 |
| WO | 2004/101923 | A1 | 11/2004 |

* cited by examiner

*Primary Examiner* — Carlos Lugo
(74) *Attorney, Agent, or Firm* — Quarles & Brady LLP

(57) ABSTRACT

An opening and/or closing mechanism for a motor vehicle, with a lock having a housing, in which there is arranged at least one retention element, which has a pawl and a rotary latch, and with a closing element, which is in operative connection with the lock in the closed position, it being possible for the rotary latch to be moved between a release position and a retention position, in which it catches the closing element. In the event of deformation of the housing, the housing is contacted at least partially by the retention element in order to prevent the door from opening, wherein at least one stop surface of a rotary latch section of the rotary latch enters into a positive-locking connection with the housing.

16 Claims, 3 Drawing Sheets

FIG. 4
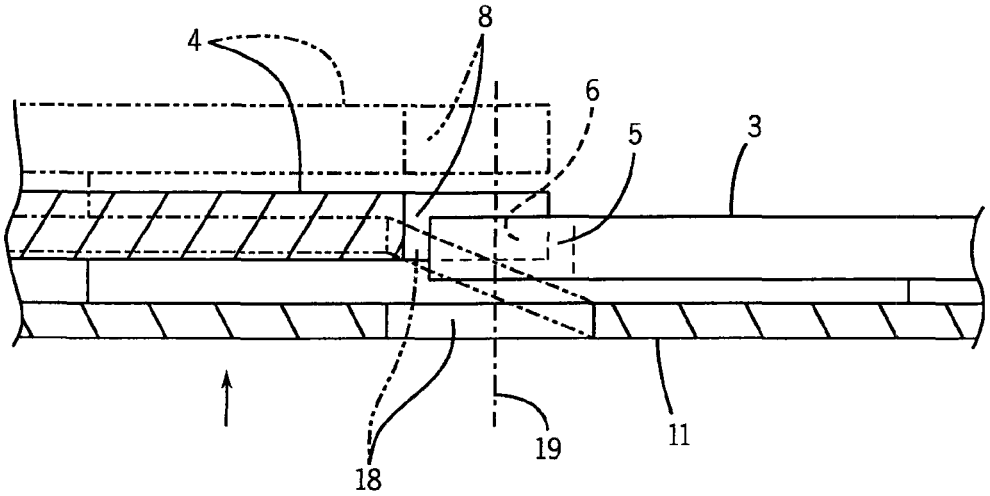
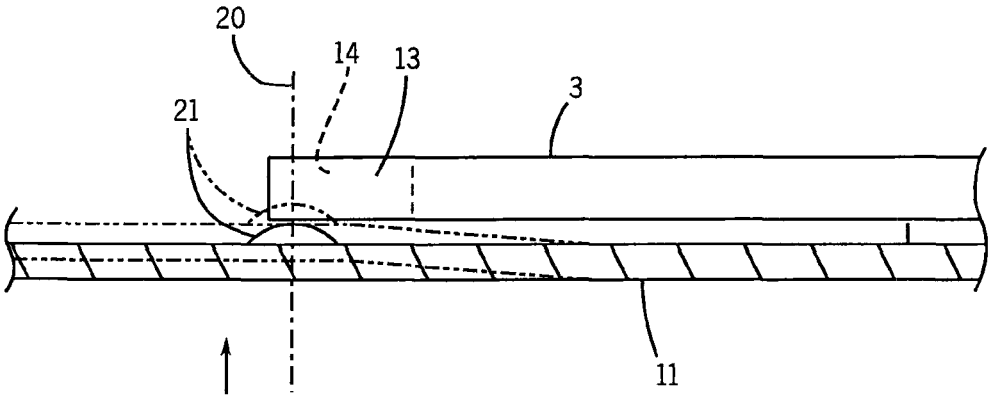
FIG. 5

OPENING AND/OR CLOSING MECHANISM ON DOORS, GATES/FLAPS OR THE LIKE, IN PARTICULAR ON MOTOR VEHICLES

CROSS REFERENCE TO RELATED APPLICATION

This application claims priority to German Patent Application No. 10 2009 050 905.4, filed on Oct. 24, 2009, and German Utility Model No. 20 2009 010 681.0, filed on Aug. 7, 2009, both of which are fully incorporated herein by reference.

STATEMENT REGARDING FEDERALLY SPONSORED RESEARCH OR DEVELOPMENT

Not applicable.

FIELD OF THE INVENTION

The invention relates to an opening and/or closing mechanism on doors, gates/flaps or the like for a motor vehicle, with a lock having a housing, in which there is arranged at least one retention element, which has a pawl and a rotary latch, and with a closing element designed as a striker hoop, which is in operative connection with the lock in the closed position, it being possible for the rotary latch to be moved between a release position and a retention position, in which it catches the closing element, and the rotary latch having at least one rotary latch section with at least one stop surface, and the pawl having at least one pawl section with at least one stop surface, and, in the retention position, the stop surface of the rotary latch section and the stop surface of the pawl section touching in a contact region, and, in the event of deformation of the housing, the housing being contacted at least partially by the retention element, in particular by a section of the rotary latch, in order to prevent the door from opening.

BACKGROUND OF THE INVENTION

Locks which have a rotary latch and a pawl are known from the prior art. Under heavy loads transverse to the direction of opening, the rotary latch and the pawl disengage, with the result that the lock could open prematurely in the event of an impact.

German Laid-Open Application DE1948907 describes a vehicle door lock which has a rotary latch and a pawl. The rotary latch has a latching projection which, in the event of deformation of the housing, forms a positive-locking joint with a side wall of the housing in order to prevent the door from opening. However, the disadvantage with this solution is that the rotary latch must additionally be provided with a latching projection, the only function of which is to form a positive-locking joint with the aperture in the housing in the event of deformation of the housing, e.g. in the event of a crash. This entails a greater effort on production, resulting in an unnecessary increase in production costs.

A vehicle door lock which has a rotary latch and a pawl is likewise known from German Utility Model DE202005005689U1, in particular the illustrative embodiment shown in FIG. 19. In this solution, the rotary latch has two latching projections, which are aligned perpendicularly in the direction of the housing, in order to form a positive-locking joint with the apertures in the housing in the event of a crash. In this case, however, the housing is not deformed; instead, the rotary latch is tilted by virtue of a predetermined bending point B on the holding element which supports the rotary latch.

This solution has the disadvantage that the holding element has to have a predetermined bending point. This in turn is associated with a greater effort on production, which increases design costs.

The prior art also includes U.S. Pat. No. 6,010,164A, which discloses a vehicle door lock. In this solution, the housing has a projection which, once again, forms a positive-locking joint with a projection arranged on the rotary latch in the event of deformation of the housing in order to prevent the door from opening. In this vehicle lock too, however, increased effort on design is required since the rotary latch and the housing have additionally to be constructed with a projection.

SUMMARY OF THE INVENTION

It is therefore the object of the invention to provide a device of the type stated at the outset which ensures that the doors and gates/flaps of the vehicle remain closed, even in the event of an impact, in particular in the event of a crash, and which is simple and economical to produce.

This object is achieved by virtue of the fact that, in the event of deformation of the housing in the retention position, at least one stop surface of a rotary latch section of the rotary latch enters into a positive-locking connection with the housing.

The solution according to the invention offers the advantage that, in contrast to the prior art, the stop surface of the rotary latch section of the rotary latch, which makes contact with the stop surface of the pawl section of the pawl in a contact region in the retention position, simultaneously has the function of forming a positive-locking joint with the housing in the event of deformation of the housing. Therefore, it is advantageously possible to dispense with an additional component arranged on the rotary latch, such as a latching projection. Accordingly, the stop surface of the rotary latch section of the rotary latch has two functions. In routine operation, i.e. in the retention condition, it serves, in operative connection with the stop surface of the pawl section of the pawl, to hold the door in a locked condition. In the event of a crash, it ensures that the door is not opened and that the occupants are not thrown out of the vehicle, because the stop surface of the rotary latch section of the rotary latch forms a positive-locking joint with the housing. Consequently, the design effort and production costs are reduced without sacrificing safety.

In order to further enhance the safety of the vehicle occupants in a crash, a further embodiment of the subject matter of the invention envisages that the rotary latch has at least one further rotary latch section with a second stop surface, which enters into a positive-locking connection with the housing during the deformation of the housing.

According to another preferred embodiment of the invention, the housing is assigned at least one means, with which at least one stop surface of a rotary latch section enters into a positive-locking connection.

According to another embodiment, the means is designed as a depression in the housing, with which at least one stop surface of a rotary latch section enters into a positive-locking connection. This ensures that the positive-locking connection between the housing and the stop surface of the rotary latch section of the rotary latch is retained in a crash and opening of the door is impossible. The depression in the housing is simple and economical to produce.

According to an alternative embodiment, the means is designed as a projection in the housing, with which at least one stop surface of a rotary latch section enters into a positive-locking connection.

According to another alternative embodiment, the means is designed as an aperture in the housing, with which at least one stop surface of a rotary latch section enters into a positive-locking connection. The aperture offers the advantage that it is very simple to integrate into a lock housing already known from the prior art. This is preferably carried out by drilling or punching.

The aperture preferably lies in a plane which is parallel to a plane in which the side walls of the rotary latch lie. This ensures that the transverse or impact forces that arise in a crash, which act substantially perpendicular to the side walls of the rotary latch, guide the stop surface of the rotary latch section of the rotary latch into the aperture in the housing, with the result that a positive-locking connection is formed between the stop surface and the aperture, preventing the door from opening.

According to another preferred embodiment, the means arranged in the housing is arranged on a first path, which is traveled by at least one rotary latch section having at least one stop surface during the opening/closing process.

If the means, e.g. the abovementioned aperture, is arranged on the first path, this ensures that the stop surface of the rotary latch section of the rotary latch forms a positive-locking joint with the aperture in the event of deformation of the housing. It is also possible to arrange on the path a plurality of means arranged at predetermined intervals with respect to one another. Thus, for example, a plurality of apertures can be arranged on a path and can be available for a positive-locking connection with at least one stop surface of a rotary latch section, depending on the deformation of the housing and the position of the rotary latch.

The construction of the lock is very reliable and simple if the means assigned to the housing is arranged on the first path opposite the contact region.

According to another embodiment of the lock, the means arranged in the housing is arranged on a second path, which is arranged offset in the vicinity of the first path, which is traveled by at least one rotary latch section having at least one stop surface during the opening/closing process.

The means assigned to the housing is then preferably arranged on the second path, which is arranged substantially opposite the contact region.

According to another preferred embodiment, the means is arranged on a rear side of a back plate of the housing.

The security of the lock against unintentional opening of the door in a crash is further enhanced if at least one stop surface of a rotary latch section is designed as a projection which enters into a positive-locking connection with the means assigned to the housing.

The lock is preferably arranged under an internal door panel of a vehicle, especially on a vehicle door.

BRIEF DESCRIPTION OF THE DRAWINGS

The invention is illustrated in the figures by means of an illustrative embodiment. In the drawing:

FIG. 4 shows the tailgate lock in a cross-sectional view taken along line 4-4 in FIG. 1 with the housing being deformed such that the stop surface of the first section of the rotary latch enters into a positive-locking connection with the housing.

FIG. 5 shows the tailgate lock in a cross-sectional view taken along line 5-5 in FIG. 1, but without the pawl, with the housing being deformed such that the surface of the second section of the rotary latch enters into a positive-locking connection with the housing.

DETAILED DESCRIPTION OF THE EXAMPLE EMBODIMENTS

Figure 1:
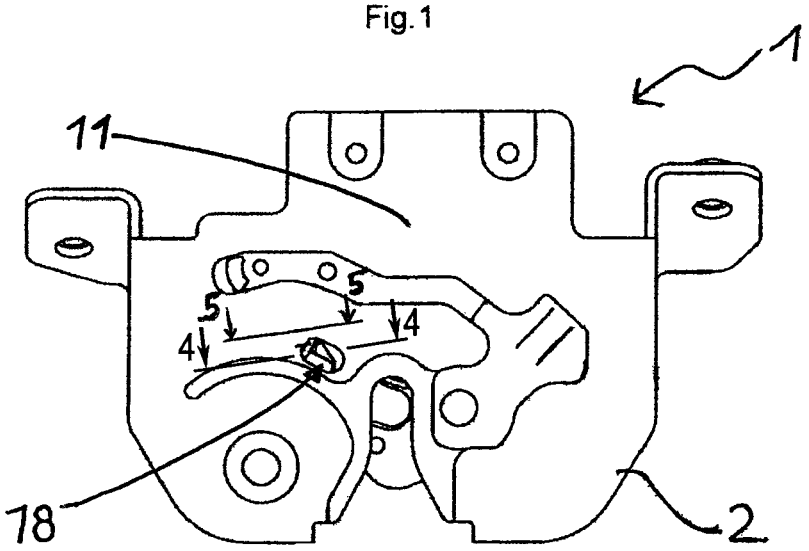
FIG. 1 shows the rear side of a tailgate lock incorporating the present invention.
Figure 2:
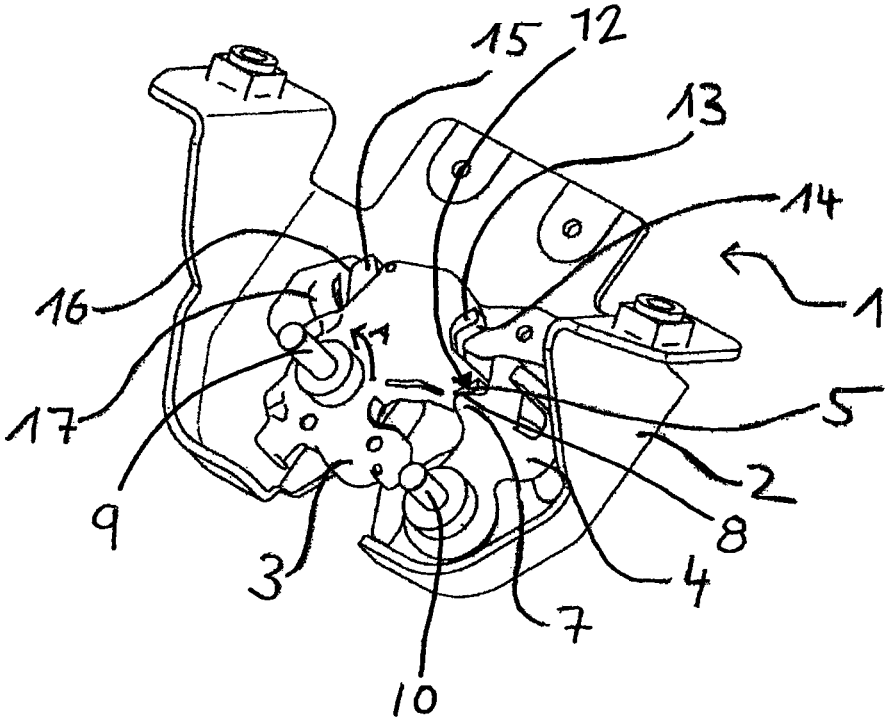
FIG. 2 shows the tailgate lock in a perspective view.
Figure 3:
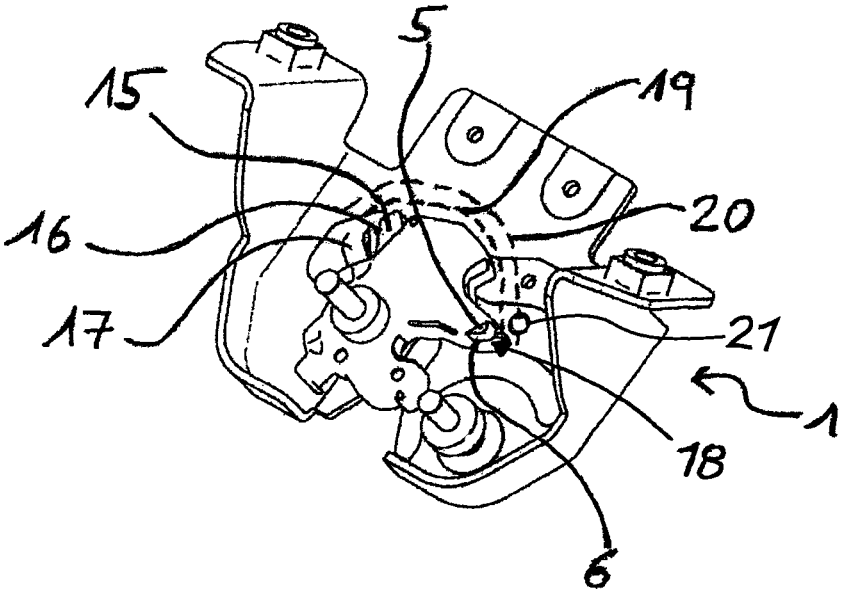
FIG. 3 shows the tailgate lock in a perspective view without the pawl.

FIGS. 1 to 3 show a tailgate lock 1 designed as an opening and closing mechanism for a tailgate (not shown specifically) of a motor vehicle, said lock being arranged under an internal door panel of a vehicle, especially on a vehicle door.

A closing element (not shown specifically), known from the prior art and designed as a striker hoop, which is of U-shaped design and is securely connected to the vehicle, is in operative connection with the tailgate lock 1 in a closed position and thus prevents the tailgate from opening.

The tailgate lock 1 has a housing 2. Arranged within the housing are retention elements, which are designed as a rotary latch 3 and a pawl 4, it being possible for the rotary latch 3 to be moved between a release position and a retention position, in which it catches the closing element.

In the retention position, a distinction is drawn between two states, namely between a main detent retention position and a preliminary detent retention position. In the main detent retention position, the tailgate is firmly closed and, in the preliminary detent retention position, the tailgate is in a lightly closed state with a gap between the body frame and door.

The rotary latch 3 has a first rotary latch section 5 with a first stop surface 6 designed as a main detent, and the pawl 4 has a pawl section 7 with a stop surface 8. The rotary latch 3 and the pawl 4 are each supported so as to be rotatable, by means of a spring (not shown specifically), the rotary latch 3 via a pin 9 and the pawl 4 via a pin 10, each of which pins is secured rotatably on a rear side 11 of the housing 2.

The first stop surface 6 of the rotary latch 3 and the stop surface 8 of the pawl are each designed in the form of a tooth and, in the retention position of the tailgate lock 1, the first stop surface 6 of the first rotary latch section 5 of the rotary latch 3 and the stop surface 8 of the pawl section 7 of the pawl 4 touch in a contact region 12. In this case, the tailgate lock 1 with the striker hoop is in the main detent retention position (see FIG. 2).

The rotary latch 3 is furthermore assigned another, second, rotary latch section 13 with a second stop surface 14. In the preliminary detent retention position, the stop surface 14 of the second rotary latch section 13 makes contact with the stop surface 8 of the pawl section 7 of the pawl 4, thus preventing opening of the tailgate. The second stop surface 14 of the second rotary latch section 13 of the rotary latch 3 accordingly acts as a preliminary detent.

The preliminary detent is provided as a safety device in order to keep the door in the closed position if the main detent position fails, especially while the vehicle is being driven. Failure of the main detent retention position can occur if, after the closing process for example, the first stop surface 6 of the first rotary latch section 5 of the rotary latch 3 and the stop surface 8 of the pawl section 7 of the pawl 4 touch only tangentially in the contact region 12 and form a nonpositive connection, because even slight forces arising while a motor vehicle is being driven and acting on the tailgate lock 1 can disengage this connection. If this connection is disengaged, the preliminary detent, which is designed as stop surface 14 of the rotary latch section 13, serves as a safety element, preventing opening of the tailgate.

Moreover, the rotary latch 3 has another, third, rotary latch section 15 with a third stop surface 16. A stop 17 securely connected to the rear side 11 is arranged on the inner rear side of the housing 2. In the retention position—both in the main detent retention position and in the preliminary detent retention position—the stop 17 and the third stop surface 16 of the third rotary latch section 15 are in a contact-free state. When the tailgate lock 1 leaves the retention position, the rotary latch 3 rotates back in the direction of arrow A, and the third stop surface 16 of the third rotary latch section 15 of the rotary latch 3 strikes the stop 17. Consequently, the striker hoop and the rotary latch 3 are out of contact and opening of the tailgate designed as a door is possible. The stop 17 thus serves as a limit for rotation of the rotary latch 3. In the event of a crash, particularly a rear impact on the motor vehicle, the housing 2 of the tailgate lock may be deformed due to the action of transverse forces. If the housing is deformed, at least one stop surface 6, 14 of a rotary latch section 5, 13 of the rotary latch will enter into a positive-locking connection with the housing 2, as shown in FIGS. 4 and 5, respectively. In the illustrative embodiment under consideration, either the first stop surface 6 (main detent)—when the rotary latch 3 is in the main detent retention position—or the second stop surface 14 (preliminary detent)—when the rotary latch 3 is in the preliminary detent retention position—will enter into a positive-locking connection with the housing 2, in particular with the rear wall of the housing 2, depending on the retention position.

The housing 2 of the tailgate lock 1 is assigned a means 18, with which the respective stop surface 6, 14 enters into a positive-locking connection during the deformation of the housing 2.

In the illustrative embodiment under consideration, the means 18 is designed as an aperture, with which the first stop surface 6 of the first rotary latch section 5 or the second stop surface 14 of the rotary latch section 13 enters into a positive-locking connection—depending on the retention position—the aperture being arranged, relative to the contact region 12, on a first path 19, which is traveled by the first rotary latch section 5 and the second rotary latch section 13 during the opening/closing process, as illustrated in FIG. 4. In FIG. 1, it can be seen that the aperture lies in a plane which is parallel to the plane in which the side wall of the rotary latch 3 lies. As an alternative, the means 18 can also be designed as a depression. It is likewise possible for the housing 2 to have a means 18 designed as a projection 21, as shown in in FIGS. 3 and 5, with which the first stop surface 6 of the first rotary latch section 5 or the second stop surface 14 of the second rotary latch section 13 of the rotary latch 3 forms a positive-locking joint in the event of deformation of the housing 2. It is also possible to provide the rotary latch sections 5, 13, 15 with projections which are aligned in the direction of the rear side 11 of the housing 2 and form a positive-locking joint with the means 18 (aperture, depression, projection) in the event of deformation of the housing 2, in order to prevent the door, in particular the tailgate, from opening in the event of a crash.

The transverse forces which occur during a crash have the effect that the housing 2 is deformed (as shown in FIGS. 4 and 5) and, as a result, in the case of the main detent retention position the first rotary latch section 5 of the rotary latch 3 and the pawl section 7 of the pawl 4 are pushed into different planes from one another, with the result that the first stop surface 6 of the rotary latch 3 and the stop surface 8 of the pawl 4 move out of contact in the contact region 12. The same applies mutatis mutandis in the case of the second rotary latch section 13 of the rotary latch 3 when the lock is in the preliminary detent retention position.

An alternative embodiment envisages that the means be arranged on a second path 20, such as the projection 21 shown in FIGS. 3 and 5, which is arranged offset in the vicinity of the first path 19. The means 18 are then preferably arranged substantially opposite the contact region 12.

It is likewise possible to provide, in the vicinity of the stop 17, a means 18 which forms a positive-locking joint with the third stop surface 16 of the third rotary latch section 15 of the rotary latch 3 in the event of deformation of the housing 2 during the crash.

It is also possible to provide a plurality of means 18 in the tailgate lock in order to further enhance safety. Thus it is possible, for example, to arrange one aperture on the first path 19 in the vicinity of the stop 17 and another aperture on the second path 20, substantially opposite the contact region 12.

In this illustrative embodiment, reference is made to a tailgate. The invention is not restricted to tailgates and can, of course, also be used with any other form of door, such as side doors, front gates/flaps and the like.

The invention claimed is:

1. An opening and closing mechanism for a motor vehicle having a door, said mechanism comprising:

a lock having a housing, in which there is arranged a retention element, which has a pawl and a rotary latch, and with a closing element designed as a striker hoop, which is in operative connection with the lock in a closed position, it being possible for the rotary latch to be moved between a release position and a retention position, in which the rotary latch catches the closing element, the rotary latch having at least one rotary latch section with a stop surface, and the pawl having a pawl section with a stop surface, and, in the retention position, the stop surface of the at least one rotary latch section and the stop surface of the pawl section touching in a contact region, and, upon deformation of the housing, the housing being contacted at least partially by the retention element, in particular by a section of the rotary latch, in order to prevent the door from opening, wherein upon deformation of the housing in the retention position, the stop surface of the at least one rotary latch section of the rotary latch enters into a positive-locking connection with the housing, the positive-locking connection preventing the door from opening.

2. The opening and closing mechanism as claimed in claim 1, wherein the rotary latch has at least one further rotary latch section with a second stop surface, which enters into a positive-locking connection with the housing during the deformation of the housing.

3. The opening and closing mechanism as claimed in claim 1, wherein the housing includes a first means for forming the positive-locking connection with the stop surface of the at least one rotary latch section.

4. The opening and closing mechanism as claimed in claim 3, wherein the first means for forming the positive-locking connection is designed as a depression in the housing.

5. The opening and closing mechanism as claimed in claim 3, wherein the first means for forming the positive-locking connection is designed as a projection in the housing.

6. The opening and closing mechanism as claimed in claim 3, wherein the first means for forming the positive-locking connection is designed as an aperture in the housing.

7. The opening and closing mechanism as claimed in claim 6, wherein the aperture lies in a plane which is parallel to a plane in which side walls of the rotary latch lie.

8. The opening and closing mechanism as claimed in claim 3, wherein the first means for forming the positive-locking connection arranged in the housing is arranged on a first path, which is traveled by the at least one rotary latch section having the stop surface.

9. The opening and closing mechanism as claimed in claim 8, wherein the first path is opposite the contact region.

10. The opening and closing mechanism as claimed in claim 8, further comprising a second means for forming the positive-locking connection, wherein the second means for forming the positive-locking connection arranged in the housing is arranged on a second path, which is arranged offset in the vicinity of the first path.

11. The opening and closing mechanism as claimed in claim 10, wherein the second path is arranged substantially opposite the contact region.

12. The opening and closing mechanism as claimed in claim 3, wherein the first means for forming the positive-locking connection is arranged on a back plate of the housing.

13. The opening and closing mechanism as claimed in claim 3, wherein the stop surface of the at least one rotary latch section is designed as a projection which enters into a positive-locking connection with the first means for forming the positive-locking connection assigned to the housing.

14. The opening and closing mechanism as claimed in claim 1, wherein the lock is arranged under an internal door panel of the door of the motor vehicle.

15. The opening and closing mechanism as claimed in claim 1, wherein the positive-locking connection entered into between the stop surface of the at least one rotary latch section of the rotary latch and the housing provides contact between the stop surface of the at least one rotary latch section of the rotary latch and the housing.

16. The opening and closing mechanism as claimed in claim 15, wherein the contact between the stop surface of the at least one rotary latch section of the rotary latch and the housing prevents the rotary latch from rotating.

* * * * *

UNITED STATES PATENT AND TRADEMARK OFFICE

CERTIFICATE OF CORRECTION

PATENT NO. : 9,347,246 B2
APPLICATION NO. : 12/849434
DATED : May 24, 2016
INVENTOR(S) : Orzech et al.

It is certified that error appears in the above-identified patent and that said Letters Patent is hereby corrected as shown below:

In the specification,
Column 4, Line 6
"the surface" should be --the stop surface--

Signed and Sealed this
Twenty-sixth Day of July, 2016

Michelle K. Lee

Michelle K. Lee
*Director of the United States Patent and Trademark Office*